US006799352B2

(12) United States Patent
Gilchrist et al.

(10) Patent No.: US 6,799,352 B2
(45) Date of Patent: Oct. 5, 2004

(54) ZERO BACKLASH ASSEMBLY

(75) Inventors: Raymond T. Gilchrist, Tucson, AZ (US); Leonard J. Ness, Tucson, AZ (US)

(73) Assignee: Boeckler Instruments

( * ) Notice: Subject to any disclaimer, the term of this patent is extended or adjusted under 35 U.S.C. 154(b) by 0 days.

(21) Appl. No.: 10/211,719

(22) Filed: Aug. 1, 2002

(65) Prior Publication Data

US 2004/0020009 A1 Feb. 5, 2004

(51) Int. Cl.[7] ..... E05D 11/04
(52) U.S. Cl. ..... 16/276; 16/224; 16/225
(58) Field of Search ..... 16/276, 224, 225; 384/1–6, 445; 74/440, 441, 445

(56) References Cited

U.S. PATENT DOCUMENTS 3,691,788 A * 9/1972 Mazziotti ..... 464/139
3,758,173 A * 9/1973 Bucher ..... 384/6
3,875,761 A * 4/1975 Bergson ..... 464/160
4,221,438 A * 9/1980 Sitte et al. ..... 384/445
4,279,173 A * 7/1981 Krebs et al. ..... 74/441
4,395,075 A * 7/1983 Barrett et al. ..... 384/2
4,589,298 A * 5/1986 Meyer et al. ..... 74/441
4,858,486 A * 8/1989 Weyer ..... 74/409
5,435,651 A * 7/1995 Everman ..... 384/452
5,839,321 A * 11/1998 Siemons ..... 74/441

* cited by examiner

*Primary Examiner*—Chuck Mah
(74) *Attorney, Agent, or Firm*—Mark Ogram

(57) ABSTRACT

A hinge assembly which creates a zero backlash situation. The base member has multiple seats, each having two contact ridges. The contact ridges are formed by an intersection of two planes (ideally substantially ninety degrees). A ball interconnect is engaged by the contact ridges of the seat on one side and a similar arrangement of contact seats on the other side (the hinge member). The diameter of the ball interconnect is larger than the distances between the contact ridges. By sandwiching the ball interconnect between the contact ridges of the base member and the contact ridges of the hinge member, a zero backlash is created in which firm and positive contact is maintained between the elements of the hinge.

13 Claims, 2 Drawing Sheets

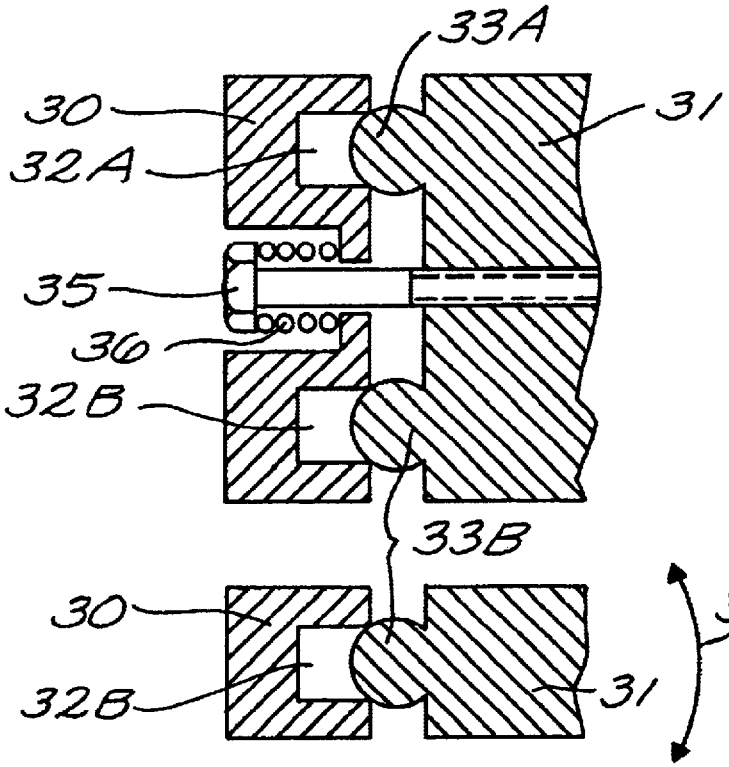
FIG. 3A
FIG. 3B
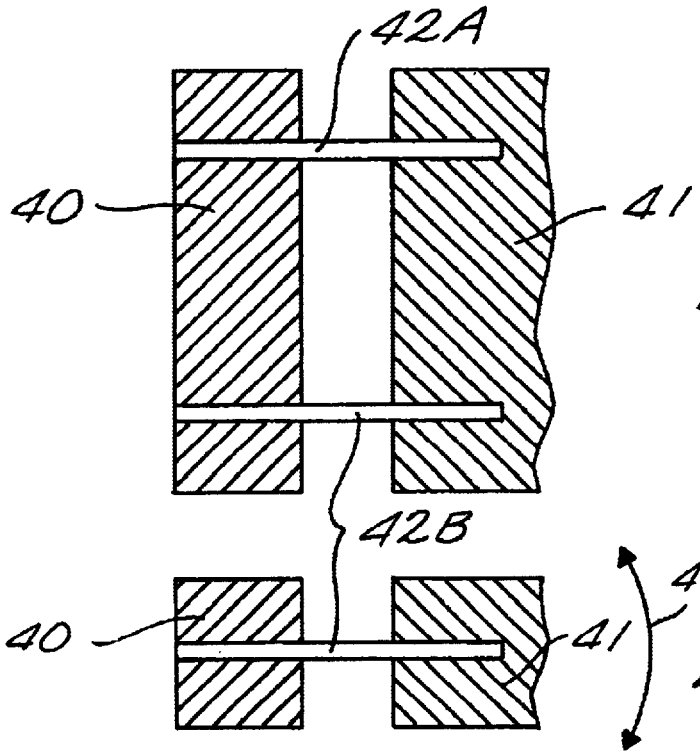
FIG. 4A
FIG. 4B

ZERO BACKLASH ASSEMBLY

BACKGROUND OF THE INVENTION

The present invention relates to mechanical assemblies and more particularly to those which attempt to achieve zero backlash characteristics.

Backlash is the relative motion of mechanical parts caused by looseness. Depending on the application a certain amount of backlash is tolerated so long as it does not affect the accuracy of the machine or instrument.

With advancements in scientific instruments, there is an increasing need for a zero backlash, or substantially zero backlash mechanical device. To this end a large number of devices have been developed in an effort to obtain this objective.

A simple solution is described in U.S. Pat. No. 4,589,298, entitled "Zero Backlash Drive Mechanism" issued to Meyer et al. on May 20, 1986. This attempt at obtaining zero backlash is designed to assure that a bolt's backlash is minimized. The technique used to spring load the bolt, thereby keeping the bolt's threads pressed against the bore's threads.

While this approach may work for the securing of the bolts it is totally incapable of addressing an assembly where relative motion between parts is required, An apparatus which attempts to produce zero backlash for apparatus with relative motion is described in U.S. Pat. No. 4,221,438, entitled, "Bearing System for the Pivot Bar of Microtomes Particularly Ultramicrotomes" issued on Sep. 9, 1980 to Sitte et al., incorporated hereto by reference.

This patent mounts two assemblies to each other by using a set of balls which are cradled by one assembly while the ball is secured to another frame. In this application, backlash is crated by the required machining of the parts. This was required because of the cradling surfaces, but, a totally matching of the cradling surfaces to the ball's exterior surface is impossible.

It is clear from the foregoing that there is a need for an assembly which approaches zero backlash characteristics.

SUMMARY OF THE INVENTION

The invention is a hinge assembly which creates a zero backlash situation. In this context, the term "zero" backlash is the attempt to approach the tolerances which will accomplish a true zero backlash. Those of ordinary skill in the art readily recognize that an absolute "zero" is never achievable, but, is approached.

The hinge of the present invention has two major components: (1) the base member which is affixed to a stationary platform; and (2) the hinge member which moves relative to the base member.

The base member has multiple seats having two contact ridges. Each of the seats are formed by a pair of parallel (or substantially parallel) ridges. The contact ridges are spaced apart at a set distance, "x". The distance x is chosen to meet the specific needs of the hinge. That is, where the hinge is small, x is less than when the hinge is larger.

The contact ridges are formed by an intersection of two planes. Ideally these planes intersect at substantially ninety degrees. The invention is not limited to only a ninety degree intersection and those of ordinary skill in the art readily recognize that this angle can be enlarged above ninety degrees, or reduced below ninety degrees.

For each seat in the base member, a ball interconnect is engaged by the contact ridges. Ideally the ball interconnect is spherical in shape and has a diameter of z. In this context, z>x, thereby allowing intersect ridges to contact the ball interconnect at single point.

In an alternative embodiment of the invention, the base member has manufactured into it a series of spherical "bulges" or bumps which serve the same purpose of the combined base member above (with seats) and the ball interconnect.

Opposing the base member is the hinged member which as a matching set of seats, each of which is also formed by two intersecting ridges. Although ideally the intersect ridges are formed by two planes intersecting at substantially right angles, those of ordinary skill in the art readily recognize that other angels of intersection are also acceptable in this context.

The distance between the contact ridges of the hinge member is y. Relationally, y<z, which allows the seat formed by the intersect ridges of the hinge member to "ride" on the ball interconnect at a single point (a line meeting a sphere).

The preferred embodiment of the invention has x substantially equal to y, but, unequal values are also acceptable so long as x<z and y<z.

The assembly is held together by any of a number of methods obvious to those of ordinary skill in the art. The preferred technique for securing the assembly together is a spring loaded bolt which extends through the base member and is screwed into the hinge member. A spring is loaded between the base member and the head of the bolt to assure that the assembly is kept pressed against each other.

Another embodiment of the invention has the bolt extending through the hinge member and secured to the base member. Again, the bolt is spring loaded and serves the same function outlined above.

By sandwiching the ball interconnect between the contact ridges of the base member and the contact ridges of the hinge member, the elements are maintained in contact, even during movement. Zero backlash is obtained because the contact between the base unit, the ball interconnect, and the hinge member, is though a series of individual points, not a milled surface. Zero backlash is created in which firm and positive contact is maintained between the elements of the hinge.

The invention, together with various embodiments thereof, will be more filly explained by the accompanying drawings and the following description thereof.

DRAWINGS IN BRIEF

FIGS. 3A and 3B are plan and side views respectively of yet another alternative embodiment of the invention.

FIGS. 4A and 4B are plan and side views respectively of an alternative embodiment of the invention.

DRAWINGS IN DETAIL

Figure 1A:
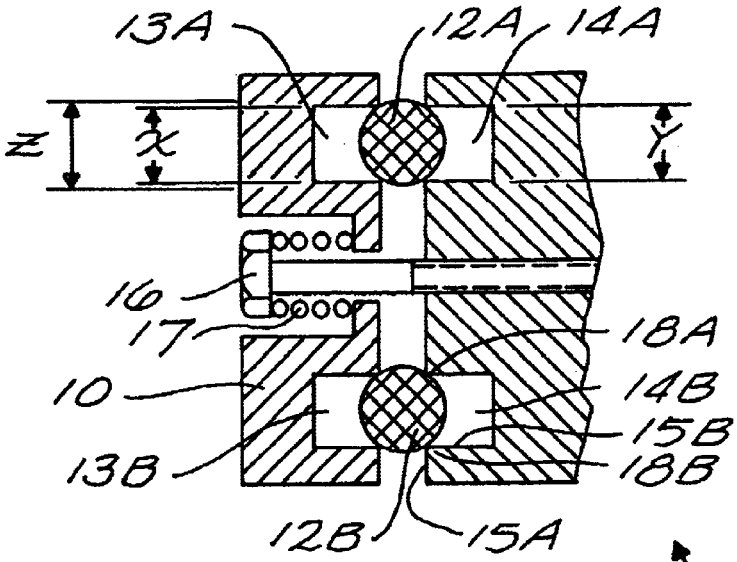
FIGS. 1A and 1B are plan and side views respectively of the preferred embodiment of the invention.
Figure 1B:
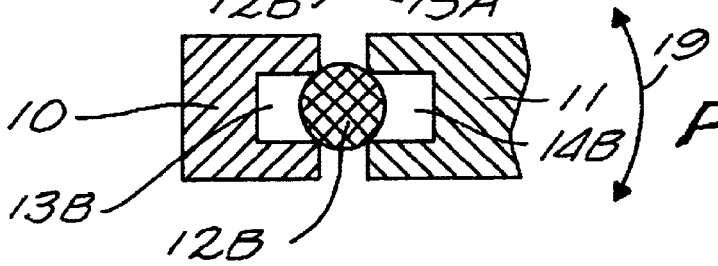

FIGS. 1A and 1B are plan and side views respectively of the preferred embodiment of the invention.

Base member 10 has seats 13A and 13B formed therein. In like manner, hinge member 11 has seats 14A and 14B formed therein. While the present drawings show the preferred use of the two seats on base member 10 and hinge member 11, the invention contemplates the use and any number N seats.

Each seat is similar to seat 14B wherein the seat includes contact ridge 18A and contact ridge 18B. As shown relative to contact ridge 18B, contact ridge 18B is formed by the intersection of planes 15A and 15B. While this illustrations shows plane 15A intersecting plane 15B substantially at right angles, other angles are also contemplated.

The contact ridges of seat 13A engage ball contact 12A on one side and the contacting ridges of seat 14A engage ball 12B on the other side. A similar arrangement is established relative to ball 12B which is engaged by seat 13B and seat 14B.

Seat 13A has a width of x; ball contact 12A has a diameter of z; seat 14A has a width of y. The relationship between these measurements is that $x<z$ and $y<z$. In the preferred embodiment x and y are at least 10 percent smaller than z; that is, $x<0.9\times z$, and $y<0.9\times z$.

Also, in the preferred embodiment x and y are substantially the same; in some embodiments x and y are not the same value.

Contact as described above is maintained bolt 16 which passes through base member 10 and engages hinge member 11. Spring 17, loaded between the head of bolt 16 and base member 10, maintains compression pressure between the elements of the assembly.

In some embodiments of the invention, seats 13A, 13B, 14A, and 14B are loaded with a lubricant during assembly to facilitate relative movement of hinge member 11 relative to base member 10 as indicated by arrow 19.

Figure 2A:
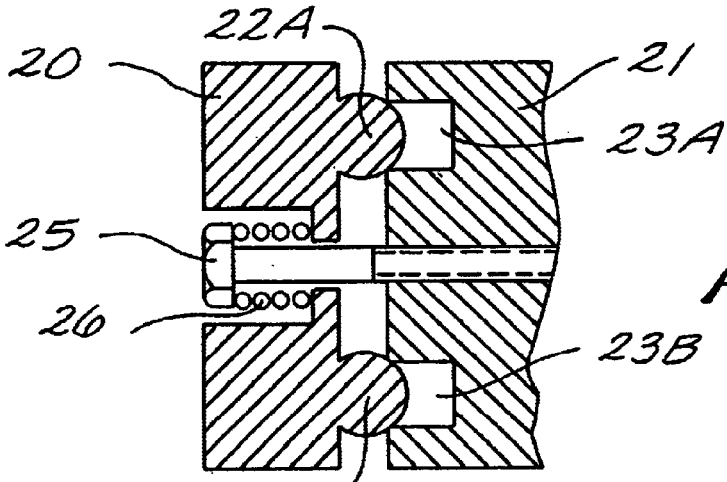
FIGS. 2A and 2B are plan and side views respectively of an alternative emodiment of the invention.
Figure 2B:
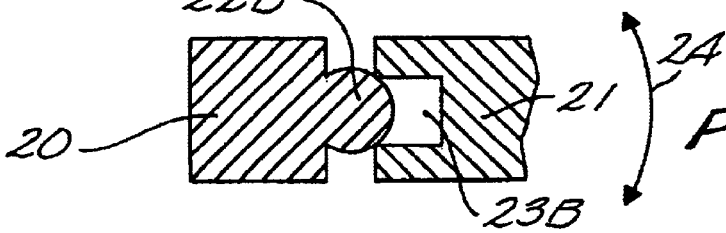

FIGS. 2A and 2B are plan and side views respectively of an alternative embodiment of the invention.

In this alternative embodiment, base member 20 is constructed with rounded protrusions 22A and 22B. Seat 23A and seat 23B of hinge member 21, engage rounded protrusions 22A and 22B respectively.

Seat 23A and seat 23B are configured as outlined above.

Again, bolt 25, loaded by spring 26, extends through base unit 20 and into hinge member 21 to maintain a firm contact between seats 23A/23B and rounded protrusions 22A and 22B respectively.

This arrangement permits relative motion 24 to occur between base member 20 and hinge member 21.

FIGS. 3A and 3B are plan and side views of yet another alternative embodiment of the invention.

In this alternative embodiment it is hinge member 31 which has the rounded protrusions 33A and 33B. Seat 32A and seat 32B arranged as outlined above are formed in base member. Seats 32A and 32B engage rounded protrusions 33A and 33B respectively.

While this embodiment shows bolt 35, loaded by spring 36, extending through base unit 30 and into hinge member 31, an opposite arrangement is also contemplated wherein the bolt extends through hinge member 31 and is secured to base unit 30.

In this manner, relative motion 34 to occur between base member 30 and hinge member 31.

FIGS. 4A and 4B are plan and side view respectively of an alternative embodiment of the invention.

This embodiment of a zero backlash hinge is formed by base member 40 and hinge member 41. Base member 40 is connected to hinge member 41 by flex rods 42A and 42B. Flex rods 42A and 42B are secured to the base member 40 and hinge member 41 using an epoxy or various other ways which firmly sets flex rods 42A and 42B.

During motion as indicated by arrow 43, flex rods 42A and 42B are able to deform or flex thereby obtaining the desired zero backlash affect.

One embodiment of the hinge of FIGS. 4A and 4B uses flat flex rods 42A and 42B; in another embodiment flex rods 42A and 42B have a square or rectangular cross section.

It is clear from the present invention provides an apparatus with zero backlash characteristics.

What is claimed is:

1. A zero backlash assembly comprising:

a) a base member having at least two seats, each of said seats having two contact ridges, each contact ridge being created by an intersection of two planes, said contact ridges for each seat being a distance x from each other; and, b) at least two balled interconnect members having a diameter z, such that $x<z$, each balled interconnect member being contained between a seat on said base member and a seat on a hinge member;

c) said hinge member having at least two seats, each of said seats having 2 contact ridges, each contact ridge being created by an intersection of two planes, said contact ridges for each seat being a distance y from each other such that $y<z$; and, d) a spring assembly pressing each of said at least two seats onto an associated support surface of said at least two balled interconnect members.

2. The zero backlash assembly according to claim 1, wherein each intersection of two planes forming the contact ridges of the hinge member insect at substantially ninety degrees.

3. The zero backlash assembly according to claim 2, wherein each intersection of two planes forming the contact ridges of the base member intersect at substantially ninety degrees.

4. The zero backlash assembly according to claim 3, wherein x is at least ten percent smaller than z.

5. The zero backlash assembly according to claim 3, wherein y is at least ten percent smaller than z.

6. The zero backlash assembly according to claim 1, wherein said spring assembly includes:

a) a bolt extending through said base member and secured to said hinge member; and, b) a spring compressed between a head of said bolt and said base member.

7. The zero backlash assembly according to claim 1, further including a lubricant deposited in each of the seats of the base member and each of the seats of the hinge member.

8. A zero backlash hinge assembly comprising:

a) a base member having two seats, each of said seats having two contact ridges being a distance x from each other and wherein each contact ridge of said hinge member is formed by an intersection of two planes substantially at ninety degrees; and, b) two balled interconnect members having a radius of z, such that $x<z$, each balled interconnect member being contained between a seat on said base member and a seat on a hinge member; and, c) said hinge member having two seats, each of said seats having two contact ridges being a distance y from each other such that $y<z$, said hinge member being pressed against said base assembly such that each of said two seats in said hinge member engage an associated support surface of said two balled interconnect members.

9. The zero backlash hinge assembly according to claim 8, wherein further including a spring assembly pressing each of said two seats onto an associated support surface, said spring assembly having:

a) a bolt extending through said base member and secured to said hinge member; and, b) a spring compressed between a head of said bolt and said base member.

10. A hinge assembly comprising:

a) a base member having two seats, each of said seats having two contact ridges, each contact ridge being created by an intersection of two planes on said base member and said contact ridges for each seat being a distance x from each other;

b) two spherical members having a diameter of z where z>x, each spherical member being engaged by a seat on said base member;

c) a hinge member having two seats, each of said seats having two contact ridges engaging one of said in spherical members, each contact ridge being created by an intersection of two planes, said contact ridges for each seat being a distance y from each other such that y<z; and, d) a spring assembly compressing said two balled interconnect members between the seats of the hinge member.

11. The hinge assembly according to claim 10, wherein each intersection of two planes forming the contact ridges of the hinge member intersect at substantially ninety degrees.

12. The hinge assembly according to claim 10, wherein each intersection of two planes forming the contact ridges of the base member intersect at substantially ninety degrees.

13. The hinge assembly according to claim 10, wherein said spring assembly includes:

a) a bolt extending through said base member and secured to said hinge member; and, b) a spring compressed between a head of said bolt and said base member.

* * * * *